US011486204B2

(12) United States Patent
Fong et al.

(10) Patent No.: US 11,486,204 B2
(45) Date of Patent: Nov. 1, 2022

(54) DISCONNECT SUB

(71) Applicant: Coretrax Technology Limited, Aberdeen (GB)

(72) Inventors: Jason Fong, Aberdeen (GB); Brian Bargewell, Aberdeen (GB)

(73) Assignee: Coretrax Technology Limited, Aberdeen (GB)

( * ) Notice: Subject to any disclaimer, the term of this patent is extended or adjusted under 35 U.S.C. 154(b) by 0 days.

(21) Appl. No.: 17/267,759

(22) PCT Filed: Aug. 6, 2019

(86) PCT No.: PCT/GB2019/052207

§ 371 (c)(1),
(2) Date: Feb. 10, 2021

(87) PCT Pub. No.: WO2020/030904

PCT Pub. Date: Feb. 13, 2020

(65) Prior Publication Data

US 2021/0164299 A1 Jun. 3, 2021

(30) Foreign Application Priority Data

Aug. 10, 2018 (GB) ..... 1813016

(51) Int. Cl.
*E21B 17/02* (2006.01)
*E21B 17/042* (2006.01)

(52) U.S. Cl.
CPC ..... *E21B 17/021* (2013.01); *E21B 17/042* (2013.01)

(58) Field of Classification Search
CPC ..... E21B 17/02; E21B 17/041; E21B 17/021; E21B 17/042; E21B 17/06
See application file for complete search history.

(56) References Cited

U.S. PATENT DOCUMENTS 2,059,175 A * 10/1936 Myracle ..... E21B 17/06 403/46
3,387,863 A 6/1968 Treese
(Continued)

FOREIGN PATENT DOCUMENTS

CN 207420480 5/2018
GB 2503986 1/2014
(Continued)

OTHER PUBLICATIONS

GB Combined Search and Examination Report for Application No. GB1911261.4 dated Jan. 16, 2020.
(Continued)

*Primary Examiner* — Kristyn A Hall
(74) *Attorney, Agent, or Firm* — Tumey L.L.P.

(57) ABSTRACT

A disconnect sub is connected at one end to a pipe for deployment into a well, where the disconnect sub is then connected to a downhole sealing device such as a plug. The disconnect sub comprises a disconnection point that has a lower tensile break value than the rest of the plug, and has a predetermined tensile break value such that the disconnection point will fail when a threshold value of axial tensile load is applied to the disconnect sub. This offers two methods of disconnection of the pipe from the plug after the plug has set—firstly, rotation of the pipe, or if rotation is not possible, overpull of the pipe in excess of the threshold will cause failure of the disconnection point and separation of the pipe from the plug.

19 Claims, 14 Drawing Sheets

(56) References Cited

U.S. PATENT DOCUMENTS

| | | | | |
|---|---|---|---|---|
| 5,303,774 | A | 4/1994 | Duhn et al. | |
| 5,732,775 | A * | 3/1998 | Hudson | E21B 17/043 166/290 |
| 8,561,692 | B1 | 10/2013 | Schultz et al. | |
| 2003/0062169 | A1 | 4/2003 | Marshall | |
| 2011/0088903 | A1 | 4/2011 | Onadeko et al. | |
| 2013/0112434 | A1 | 5/2013 | Lende et al. | |

FOREIGN PATENT DOCUMENTS

| | | |
|---|---|---|
| WO | 2016110495 | 7/2016 |
| WO | 2018140462 | 8/2018 |

OTHER PUBLICATIONS

International Search Report for Application No. PCT/GB2019/052207 dated Jan. 29, 2020.
Written Opinion of the International Searching Authority for Application No. PCT/GB2019/052207 dated Jan. 29, 2020.
GB Examination Report for Application No. GB1911261.4 dated Oct. 26, 2020.

* cited by examiner

Figure 16 – PRIOR ART

DISCONNECT SUB

FIELD OF THE INVENTION

The present invention relates to a disconnect sub, more specifically a sub which is designed to disconnect a pipe or conduit such as a drill string from a bridge plug (or similar) in an oil or gas well which leaves the pipe open-ended to allow further works to be carried out.

BACKGROUND OF THE INVENTION

Downhole sealing devices such as bridge plugs are commonly used to seal or isolate zones in a well casing to prevent escape of fluids. Conventionally, the plug is lowered into the wellbore to the desired depth and set by hydraulic and/or mechanical means to expand anchoring segments and compressing a sealing element.

Frequently, downhole sealing devices are conveyed into the wellbore, casing, or tubing on a mechanical-type setting tool that has large outer diameter components that contact the inner diameter of the casing or pipe. Once the downhole sealing device is positioned and set in the well bore at a pre-determined location, the mechanical setting tool is released from the sealing device. For further operations to commence such as cementing, the large outer diameter mechanical setting tool needs to be removed from the well completely, and replaced by a pipe having as small a diameter as possible (sometimes referred to as a "slick stinger"), which is then positioned within the well. The smaller the outer diameter pipe relative to the inner diameter of the casing the better for subsequent cementing jobs, as the cement will flow and fill up the annular area between the pipe and the casing. The small outer diameter pipe or slick stinger minimises disturbance of the cement column when the pipe is removed from the well, improving the chance of a good cement bond and increasing the likelihood of a successful cement job. This can reduce the need for any additional or remedial operations such as a further cement job at a later stage.

Generally, the sealing element of the sealing device is retained by a locking mechanism and the sealing device, such as the bridge plug, is subsequently released from the pipe, e.g. drill pipe. Any compressive force is relieved from the sealing device by e.g. lifting the drill pipe slightly or putting the drill pipe in tension slightly. The drill pipe is provided with a left-hand threaded sub or crossover at its lowermost end, so that when the pipe is rotated to the right, the presence of the left-hand thread will release the threaded coupling between the sub or crossover and the upper end of the sealing device. This is the primary, and preferred, method, however if this method fails, the secondary and alternative method is to pull the drill pipe in tension until a threaded stud breaks.

Both these methods allow the sealing device, e.g. the plug, to be released from the drill pipe using different techniques once it has set. It can be preferable to release a plug using the primary method of rotating off the plug, as this leaves an open-ended pipe, allowing further works to be carried out such as cementing operations. Since the plug is set and is anchored against the wellbore casing, it can also allow the secondary method of breaking a threaded stud by pulling up on the drill pipe. The secondary method does not, however, provide an open-ended pipe as well as retrieving the upper portion of the plug when pulling the drill pipe out of hole.

A disconnect sub is therefore desirable which will release from a downhole sealing device (either by rotation or tension) and provide ideal conditions for cementing operations or further works to be carried out after setting the downhole sealing device.

SUMMARY

According to a first aspect of the present invention there is provided a disconnect sub for connecting to a downhole sealing device for deployment in a wellbore of an oil, gas or water well, the disconnect sub comprising:

a body with a wall forming a through bore; and wherein the wall of the body comprises a disconnection point in the body, and wherein the disconnection point has a lower tensile break value than the rest of the wall of the body.

The disconnect sub advantageously has a smaller outer diameter than the mechanical setting tool. This means that using the disconnect sub to convey a downhole sealing device into the wellbore allows the sealing device to be positioned and set in the well, while permitting subsequent operations such as cementing to take place without removing the disconnect sub from the well. Optionally the disconnect sub comprises a slick outer diameter. Optionally the disconnect sub comprises an inner diameter/throughbore that is sufficiently large to permit passage of additional tools through the throughbore.

The sub is connectable to a string by means of a threaded connection commonly used in the oil and gas industry. Optionally, the thread is fluid- and pressure-retaining such as External-Upset-End (EUE). The disconnect sub can be manufactured from a variety of different materials suitable for use within a wellbore, such as metal, plastic, and/or composites. Optionally, the sub is manufactured from steel alloy, optionally low alloy steel.

Optionally the disconnect sub comprises first and second threaded ends spaced axially apart on the body. Optionally the first end comprises a right-hand thread. Optionally the first end of the disconnect sub is connectable to a pipe or conduit, for example a drill string, or a stinger, and the second end is optionally connectable to the downhole sealing device. Optionally the disconnect sub may be connected to the pipe or conduit via a connector or adapter. Running the disconnect sub on a stinger advantageously eliminates the need for a second trip to pump cement. Optionally the second end comprises a left-hand threaded connection. Optionally the second end comprises a stub ACME thread.

Optionally the disconnect sub may be disconnected from the downhole sealing device by rotating the disconnect sub to unthread the connection from the downhole sealing device. Optionally the rotation may be in a clockwise direction. Optionally the disconnect sub is disconnected by rotating the pipe that the first end of the disconnect sub is connected to. For example, the disconnect sub may be disconnected from the downhole sealing device by rotating the drill string.

Disconnection of the disconnect sub from the downhole sealing device by rotation has the advantage that the disconnect sub fully detaches leaving the sub open-ended, i.e., the throughbore of the sub remains at its full inner diameter. By having the sub open-ended, further tools may be run down through the throughbore of the string in the wellbore.

Optionally the downhole sealing device is a plug (but can also be a straddle, packer, or the like). Optionally the disconnect sub is disconnected after the plug has been set. Optionally the plug is a bridge plug, for example a permanent cast iron bridge plug. Optionally the plug is set with a combination of hydraulic pressure and mechanical pull. Optionally the plug comprises an integral setting tool.

Optionally the disconnect sub comprises a notch in the wall of the body. Optionally the notch may be filled with a different material of a lower tensile break value, for example metal, plastic, rubber, wax, or similar. Optionally filling the notch may adjust the diameter of the notched portion of the wall such that it matches the diameter of the un-notched wall on the upper and/or lower side of the notch.

Optionally the notch in the disconnect sub creates a location where the wall of the disconnect sub is thinner than the rest of the wall forming the body of the sub, such that the wall has a minimum cross-section at the notch. The notch forms a predetermined failure point, or disconnection point, in the disconnect sub, optionally with a predetermined tensile rating to allow failure when pulling the pipe, conduit, or string upwards in tension.

Optionally the disconnection point has a predetermined tensile break value, optionally such that the disconnection point will fail when a threshold value of tensile load, optionally axial tensile load, is applied to the disconnect sub.

Optionally there may be more than one notch in the wall. Optionally there may be a series of notches. For example, there may be a plurality of notches where each notch extends around a portion of the circumference of the wall of the body.

Optionally the plurality of notches may be circumferentially aligned with each other. Optionally the notches may be of differing lengths, for example a mixture of short and long notches. Optionally at least one notch may extend around the majority of the circumference of the wall of the body. Optionally at least one notch may extend uninterrupted around the entire circumference of the body.

An optional alternative release method is therefore to put the disconnect sub under tensile loading by, for example, pulling the pipe to which the disconnect sub is attached from surface (e.g. by overpull). In contrast, disconnection of a running tool by rotation requires at least ten rotations of the pipe to disconnect the running tool from a set plug. This alternative disconnection method therefore offers the advantage that the disconnect sub allows rapid disconnection from a downhole sealing device, such as a plug, providing time savings to the rig.

An operator can thus choose from both disconnection options. The first disconnection option may be useful where the tool is being used on a rig that does not meet the overpull load requirement, for example.

Optionally the ultimate tensile value of the material, e.g. the steel, is used to produce a breaking under tensile load calculation, while also considering the cross-sectional area of the disconnect point formed in the body of the sub by the notch. These values allow an expected break or tensile failure load to be calculated.

Optionally the bore of the sub allows fluid to be delivered into the downhole sealing device/plug and, once released, to the wellbore.

The notch may be formed in the outer or inner surface of the body of the disconnect sub. The notch may be machined into the wall of the body. Optionally the notch extends around the circumference of the body. Optionally the notch may be machined or formed uniformly around the entire circumference of the disconnect sub, either the inner or outer circumference. Optionally the notch is positioned adjacent to the threaded end of the disconnect sub, for example, directly above the thread. Optionally the notch is fully contained, or housed, within the female connector of the downhole sealing device/plug. This advantageously protects the disconnection point of the disconnect sub from bending loads seen at the downhole sealing device/plug which may otherwise lead to premature failure of part or all of the disconnection point.

Optionally the disconnect sub comprises the following components in order going from downhole to uphole (as the components would be in use): a left-hand threaded end, for connection with a downhole sealing device e.g. a plug; a notch adjacent to the left-hand thread; a ribbed or knurled gripping portion to which tools may attach when the disconnect sub is being connected to the sealing device and/or pipe; and a further threaded end for connection with either a pipe directly or a further connector or adapter.

When the notch is formed in the outer surface of the body of the disconnect sub, the diameter of the notched portion of the wall (i.e. the disconnection point) is smaller than the outer diameter of the sub. Similarly, when the notch is formed in the inner surface of the sub, the inner diameter of the disconnection point is larger than the inner diameter of the rest of the throughbore of the sub. Optionally, the notch can be profiled to ensure a clean break, for example the notch may be a rounded groove, or a v-cut.

Optionally the diameter of the disconnection point is sized by calculating the required tensile break force, which is to be higher rated than the setting force of the sealing device/plug. Optionally the disconnection point diameter is selected to break at +/−10% of the calculated tensile break force. Optionally the material percentage elongation is selected to be low, such that the disconnect sub breaks at the disconnection point rather than stretching and/or deforming. Stretching or deformation of the open end of the disconnect sub would affect the profile of the open end and thereby potentially interfere with further operations that may be carried out that may, e.g., require tools to be passed through the throughbore of the remaining section of the disconnect sub.

Optionally the disconnect sub comprising the disconnection point may be manufactured in batches of 10 from e.g. low alloy steel. Optionally 1 out of 10 subs may be tested to failure to compare the actual tensile failure load with the theoretical tensile failure load. A test fixture can be used that allows both sides of the disconnect sub to be anchored, with a hydraulic ram to be positioned in between the two anchor points and the weak point in the sub. After the piston area of the ram has been determined, pressure may be applied to the ram until the disconnection point breaks/fails in tensile loading. The pressure recorded is multiplied by the piston area of the ram to calculate the load required to cause the disconnection point to fail.

Optionally, by way of example, when the wellbore sealing device requires a minimum setting force of 35,000 lbs (approximately 15,900 kg) to operate, the disconnect sub may be calculated to break off when around 55,000-60,000 lbs (+/−10%) (approximately 24,900-27,200 kg) of tensile load is applied. The additional 20,000 lbs (approx. 9000 kg) provides an adequate safety factor so that the sealing device will be subjected to its minimum setting force, while still allowing the equipment on a rig providing the load to set the sealing device to be able to reach the 55,000 lbs target load without reaching the limits of the rig equipment. For example, loads significantly higher than 55,000 lbs may not be achieved on some rig types or due to equipment malfunction. Other sealing devices may have higher minimum forces than the 35,000 lbs mentioned.

Tailoring the notch so that the weak point that it forms in the disconnect sub fails at a pre-selected value allows a large safety factor, and reduces the risk of the disconnect sub failing before the sealing device/plug has been fully set.

Forming the notch as a rounded groove on the inner surface of the wall of the body advantageously reduces the risk of burrs or residual broken material being left after failure of the notch, which may obstruct the remaining bore of the sub and thus reduce the effective inner diameter of the sub.

A clean break is particularly advantageous as it provides an open-ended pipe for further operations such as cementing or setting additional tools. Any unwanted restriction of the inner diameter of the bore at the disconnection point may allow subsequent tools run through the bore to become stuck or damaged, which may incur significant loss of rig time due to having to remove pipe or conduit from the well bore in order to extract the stuck or damaged tool. Having as clean a break as possible is desirable when tools are to be run through the disconnection point of the sub.

If no tools are to be run through the break point, an external notch such as a rounded groove on the external surface may be preferable, as this is typically cheaper to manufacture and easier to dimensionally inspect. However, any groove or notch profile can be chosen.

Optionally, the disconnect sub comprises an internal tapered profile in the throughbore of the disconnect sub. Optionally the internal tapered profile comprises at least one section where the internal diameter is smaller than the internal diameter of the pipe or conduit within the well that the disconnect sub is connected to. Optionally the largest internal diameter of the tapered profile is smaller than the internal diameter of the pipe or conduit. Optionally when tools are launched from the surface through the pipe or conduit within the wellbore, the tapered profile of the disconnect sub restricts the passage of the tools in a downhole direction. Optionally the tapered profile permits the disconnect sub to be used as a landing sub.

Optionally the disconnect sub comprises a diverter valve. Optionally the diverter valve is configured to direct fluid flowing in the drill string radially outwards towards the casing. Optionally the disconnect sub comprises radially arranged side ports, optionally in the wall of the body of the sub. Optionally the radially arranged side ports extend through the wall of the body between the throughbore of the disconnect sub and the outer surface of the body. Optionally the side ports are configured to permit fluid communication between the throughbore of the disconnect sub and the annulus.

Optionally the diverter valve comprises an axially movable sleeve configured to obstruct the radial side ports when in a first configuration, and optionally restrict fluid flow between the throughbore and the annulus of the wellbore in use. Optionally the sleeve is configured to expose the radial side ports when in a second configuration to permit the flow of fluid between the throughbore and the annulus of the wellbore. Optionally the sleeve comprises seals that straddle the radial ports such that the radial ports are sealed in both an uphole and a downhole direction.

Optionally the diverter valve is a ball valve. Optionally the diverter valve is actuated by dropping a ball into the drill pipe from surface. Optionally, the diverter valve comprises a ball seat. Optionally the ball seat may be mounted within the throughbore of the disconnect sub. Optionally in a first configuration the ball seat is configured to seal the side ports such that no fluid may flow through the side ports. Optionally the ball seat comprises one or more seals, optionally annular seals. Optionally the seal is made of polymeric material. Optionally the seals are located on the external surface of the ball seat. Optionally the seals are configured to seal between the external surface of the ball seat and the internal surface of the disconnect sub, i.e. the surface of the throughbore. Optionally at least one seal on the ball seat is arranged to seal the side ports, optionally by providing a fluid-resistant annular seal above the side ports (in an uphole direction). Optionally more than one seal is provided, and optionally one seal may be located below the side ports while another seal may be located above the side ports. Optionally the ball seat is made of polymeric material such as, for example, natural or synthetic rubber, silicon, or PVC. Optionally the polymeric material enhances the sealing action of the ball seat on the side ports. Optionally the ball seat comprises a through bore configured to allow fluids to flow through the ball seat without moving the ball seat from the first configuration.

Optionally, the ball seat may be profiled such that a ball (which can optionally be metal or polymeric, e.g. steel or phenolic) can be dropped from surface and land on the profile, where it is then restricted or prevented from travelling further down hole e.g. to the sealing device. Optionally the ball blocks the through bore of the ball seat, and thereby restricts fluid flow through the ball seat. Optionally the ball seals against the ball seat.

Optionally, an arrangement of shear pins maintains the position of the ball seat around the seals prior to activation, for example 2-8 shear pins, optionally symmetrically arranged around the ball seat. Optionally the number and/or the shear strength of the shear pins can be selected according to the required load or fluid pressure at which the ball seat should move to a second configuration and thereby unseal the side ports. To determine when the pins will shear, and the ball and ball seat combination will move to open the side ports, the piston area across the top of the ball seat and the shear strength of the shear pins is needed. The shear strength of the pins is calculated by multiplying the ultimate tensile strength by 60%. The shear strength of the pins is divided by the area of the ball seat, and the result is the force required to shear the pins, move the ball seat, and open the side ports.

Optionally the shear pins comprise a brass alloy. Optionally, if the shear rating is to be greater a steel alloy can be used. Optionally a grooved profile on the ball seat acts as a shear point. Optionally the shear pins are cylindrical. Optionally, steel roll pins can be used.

The shear screws are not affected by flow passing through the ball seat and therefore no movement of the ball seat will take place until a ball is landed on top of the ball seat.

Optionally the ball being positioned in the ball seat leads to an increase in fluid pressure within the wellbore, optionally above the ball seat. Optionally the fluid pressure increases until the shear pins break. Optionally, when the shear pins break, the ball seat moves to the second configuration under the influence of the increased fluid pressure, for example the ball seat may move in a downhole direction.

Optionally in the second configuration of the ball seat the side ports are exposed, while the through bore remains sealed off by the ball on the ball seat, therefore directing all fluid within the throughbore above the ball seat radially outwards into the wellbore.

Good cementing practices prefer the cement to be injected through the drill pipe and outwards into the wellbore radially as opposed to directly out the open ended pipe. Once the side ports are open, fluid flow from above will be directed radially out of the side ports and into the well bore, while the ball on the ball seat will prevent fluid from being directed out of the end of the disconnect sub.

Optionally the diverter valve may be combined with the tapered internal profile. Optionally the ball seat may be downhole of the tapered internal profile.

According to a second aspect of the present invention there is provided a method of disconnection of a pipe for deployment in a wellbore of an oil, gas, or water well from a downhole sealing device, the method comprising:

providing a disconnect sub in accordance with the first aspect of the invention;

connecting the downhole sealing device to a disconnect sub at a first end of the disconnect sub, and connecting the disconnect sub at a second end to the pipe for running downhole; and disconnecting the pipe from the downhole sealing device by applying an axial tensile load to the disconnect sub equal to or greater than the tensile break value of the disconnection point.

The various aspects of the present invention can be practiced alone or in combination with one or more of the other aspects, as will be appreciated by those skilled in the relevant arts. The various aspects of the invention can optionally be provided in combination with one or more of the optional features of the other aspects of the invention. Also, optional features described in relation to one aspect can typically be combined alone or together with other features in different aspects of the invention. Any subject matter described in this specification can be combined with any other subject matter in the specification to form a novel combination.

Various aspects of the invention will now be described in detail with reference to the accompanying figures. Still, other aspects, features, and advantages of the present invention are readily apparent from the entire description thereof, including figures, which illustrates a number of exemplary aspects and implementations. The invention is also capable of other and different examples and aspects, and its several details can be modified in various respects, all without departing from the scope of the present invention as defined by the claims. Accordingly, each example herein should be understood to have broad application, and is meant to illustrate one possible way of carrying out the invention, without intending to suggest that the scope of this disclosure, including the claims, is limited to that example. Furthermore, the terminology and phraseology used herein is solely used for descriptive purposes and should not be construed as limiting in scope. In particular, unless otherwise stated, dimensions and numerical values included herein are presented as examples illustrating one possible aspect of the claimed subject matter, without limiting the disclosure to the particular dimensions or values recited. All numerical values in this disclosure are understood as being modified by "about". All singular forms of elements, or any other components described herein are understood to include plural forms thereof and vice versa.

Language such as "including", "comprising", "having", "containing", or "involving" and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes. Thus, throughout the specification and claims unless the context requires otherwise, the word "comprises" or "comprising" will be understood to imply the inclusion of a stated integer or group of integers but not the exclusion of any other integer or group of integers.

Any discussion of documents, acts, materials, devices, articles and the like is included in the specification solely for the purpose of providing a context for the present invention. It is not suggested or represented that any or all these matters formed part of the prior art base of were common general knowledge in the field relevant to the present invention.

In this disclosure, whenever a composition, an element or a group of elements is preceded with the transitional phrase "comprising", it is understood that we also contemplate the same composition, element or group of elements with transitional phrases "consisting essentially of", "consisting", "selected from the group of consisting of", "including", or "is" preceding the recitation of the composition, element or group of elements and vice versa. In this disclosure, the words "typically" or "optionally" are to be understood as being intended to indicate optional or non-essential features of the invention which are present in certain examples but which can be omitted in others without departing from the scope of the invention.

References to directional and positional descriptions such as upper and lower end directions e.g. "up", "down" etc. are to be interpreted by a skilled reader in the context of the examples described to refer to the orientation of features shown in the drawings, and are not to be interpreted as limiting the invention to the literal interpretation of the term, but instead should be as understood by the skilled addressee. In particular, positional references in relation to the well such as "up" and similar terms will be interpreted to refer to a direction toward the point of entry of the borehole into the ground or the seabed, and "down" and similar terms will be interpreted to refer to a direction away from the point of entry, whether the well being referred to is a conventional vertical well or a deviated well.

DETAILED DESCRIPTION OF EXAMPLES OF THE INVENTION

Figure 1:
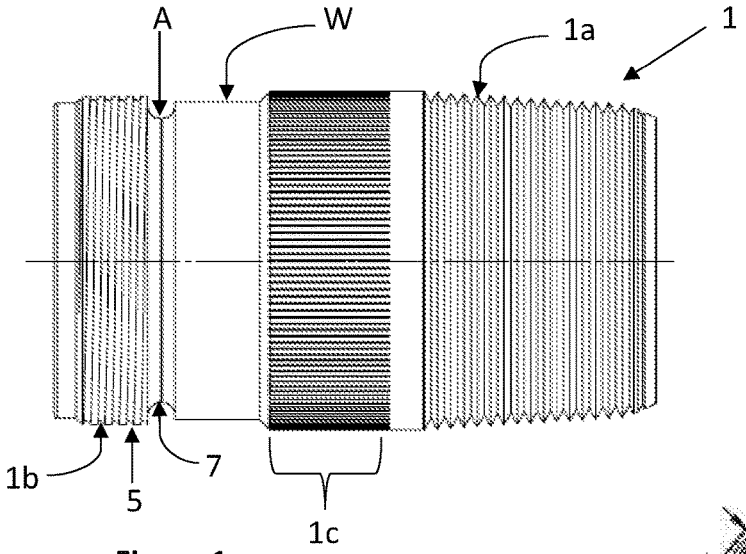
FIG. 1 shows a schematic side view of an example of a disconnect sub in accordance with the present invention, comprising a rounded groove notch on the external surface of the disconnect sub.
Figure 2:
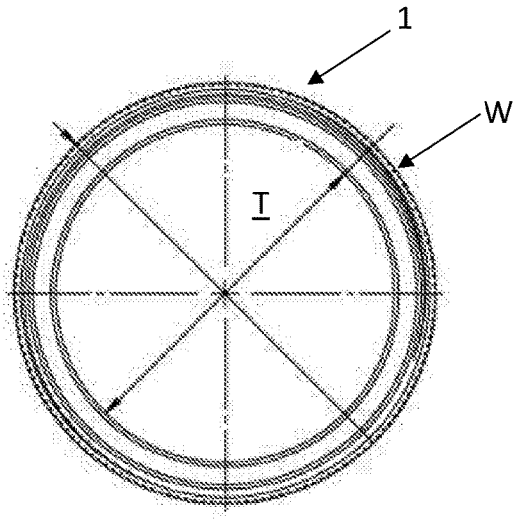
FIG. 2 shows an end view of the disconnect sub of FIG. 1.
Figure 3:
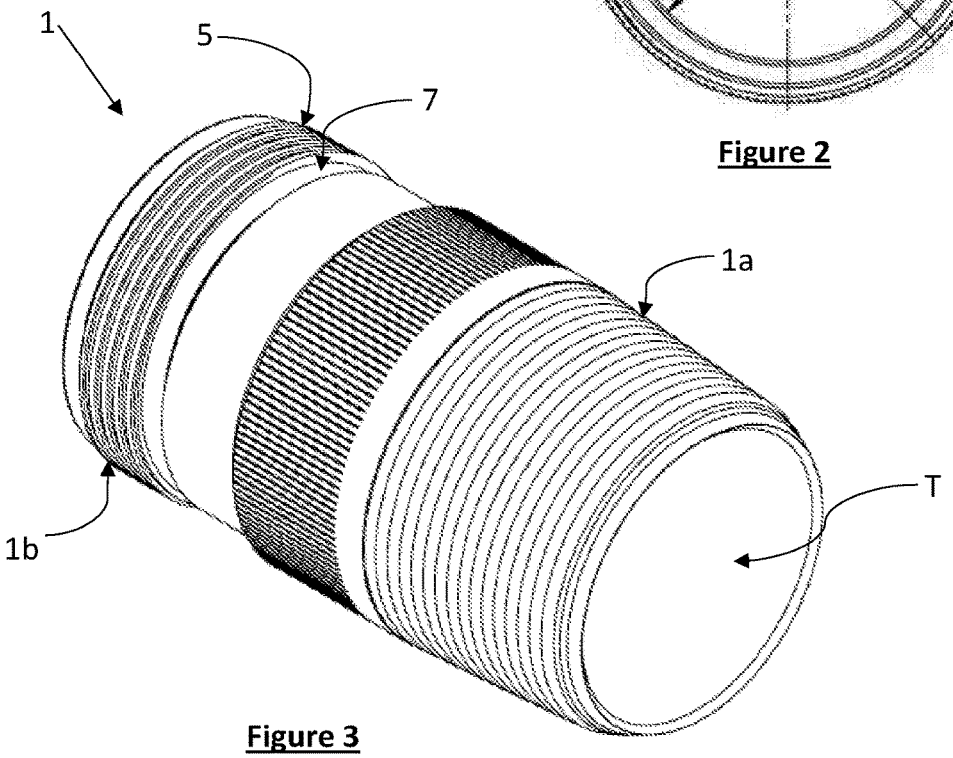
FIG. 3 shows a perspective view of the disconnect sub of FIG. 1.
Figure 4:
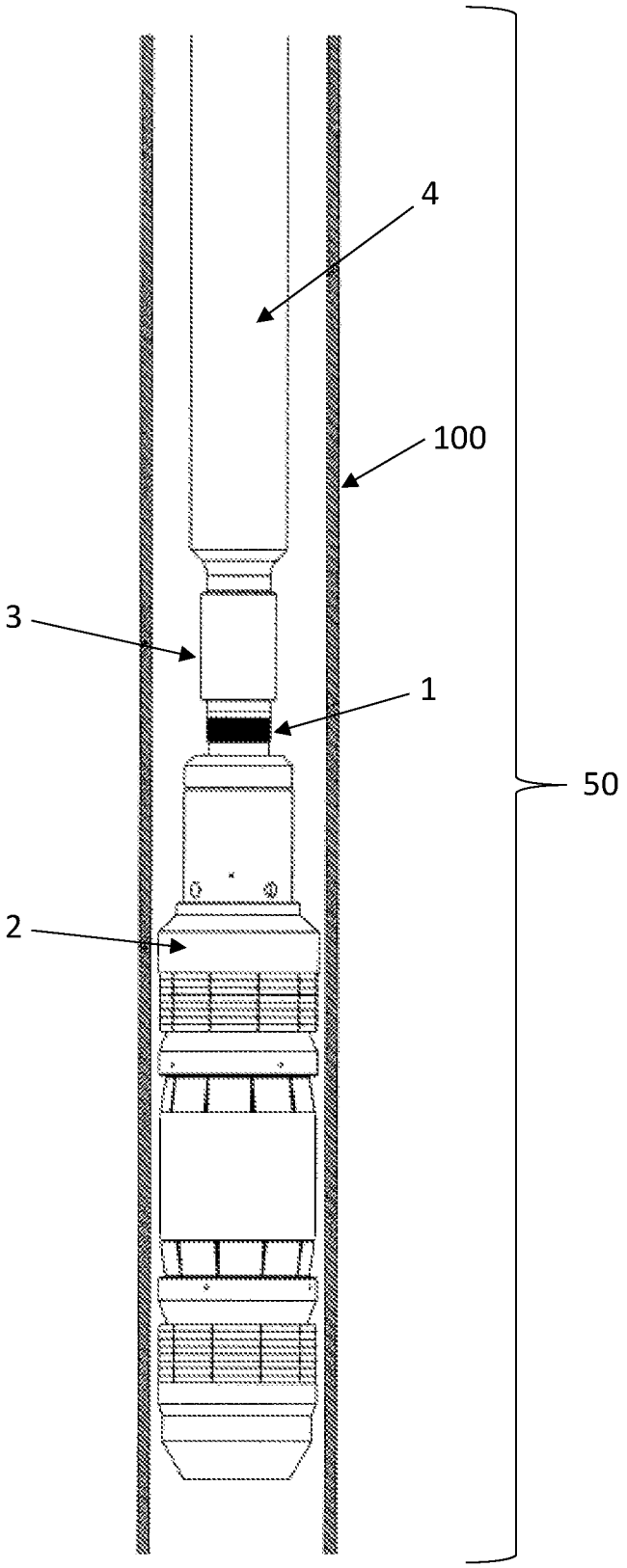
FIG. 4 shows a schematic front view of a plug with the disconnect sub of FIG. 1 in the 'running in' position as it is lowered into the wellbore.

FIGS. 1-3 show an example of a disconnect sub 1 in accordance with the present invention comprising a first threaded end 1*a*, typically a right-hand thread, for connection to the lower end of a drill string (see drill string 4 in FIG. 4) via a coupling if required (see coupling 3 in FIG. 4), and a second threaded end 1*b*, for connection to the upper end of a bridge plug (see plug 2 in FIG. 4). The disconnect sub 1 comprises a knurled/ridged section 1*c* around the circumference of the disconnect sub 1, which acts to increase friction and thereby improve grip of tools such as chain tongs that are used to make up the connection of the disconnect sub 1 and the plug 2/drill string 4/coupling 3.

Immediately adjacent to the second threaded end 1*b* there is a notch 7, in the form of a rounded groove machined into the external surface of the disconnect sub 1, uniformly around the entire circumference thereof, creating a cut-out portion of the wall W of the disconnect sub 1. In other words, the notch 7 is located immediately inbetween the uppermost end, in use, of the second threaded end 1*b* and the lowermost end, in use, of the uniform outer diameter portion of wall W. The disconnect sub comprises a throughbore T that extends axially through the length of the disconnect sub 1. The disconnect sub 1 wall W is at its thinnest point at the apex A of the notch 7. The second threaded end 1*b* unusually comprises a left-hand thread 5.

FIG. 4 shows a schematic front view of a first example of a typical plug assembly 50 in the 'running in' position comprising a disconnect sub 1, plug 2, coupling 3 and drill pipe 4; in this example, the plug 2 is a bridge plug. In FIG. 4 the plug 2 is connected to the drill pipe 4 (which could be tubing) via the disconnect sub 1 and a coupling 3. The plug assembly 50 is deployed in a wellbore 100. The plug 2 is lowered into the wellbore 100 via drill pipe 4 to the required setting depth. The disconnect sub 1 is coupled to the drill pipe 4 by the coupling 3 via a standard oilfield connection (e.g. box and pin arrangements having a conventional right-hand thread). The disconnect sub 1 is therefore coupled to the plug 2 via the male left-hand thread 5 (e.g. stub ACME or similar) of the second threaded end 1*b*. The plug 2 incorporates a sealing element which is compressed and retained by a locking mechanism.

Figure 5:
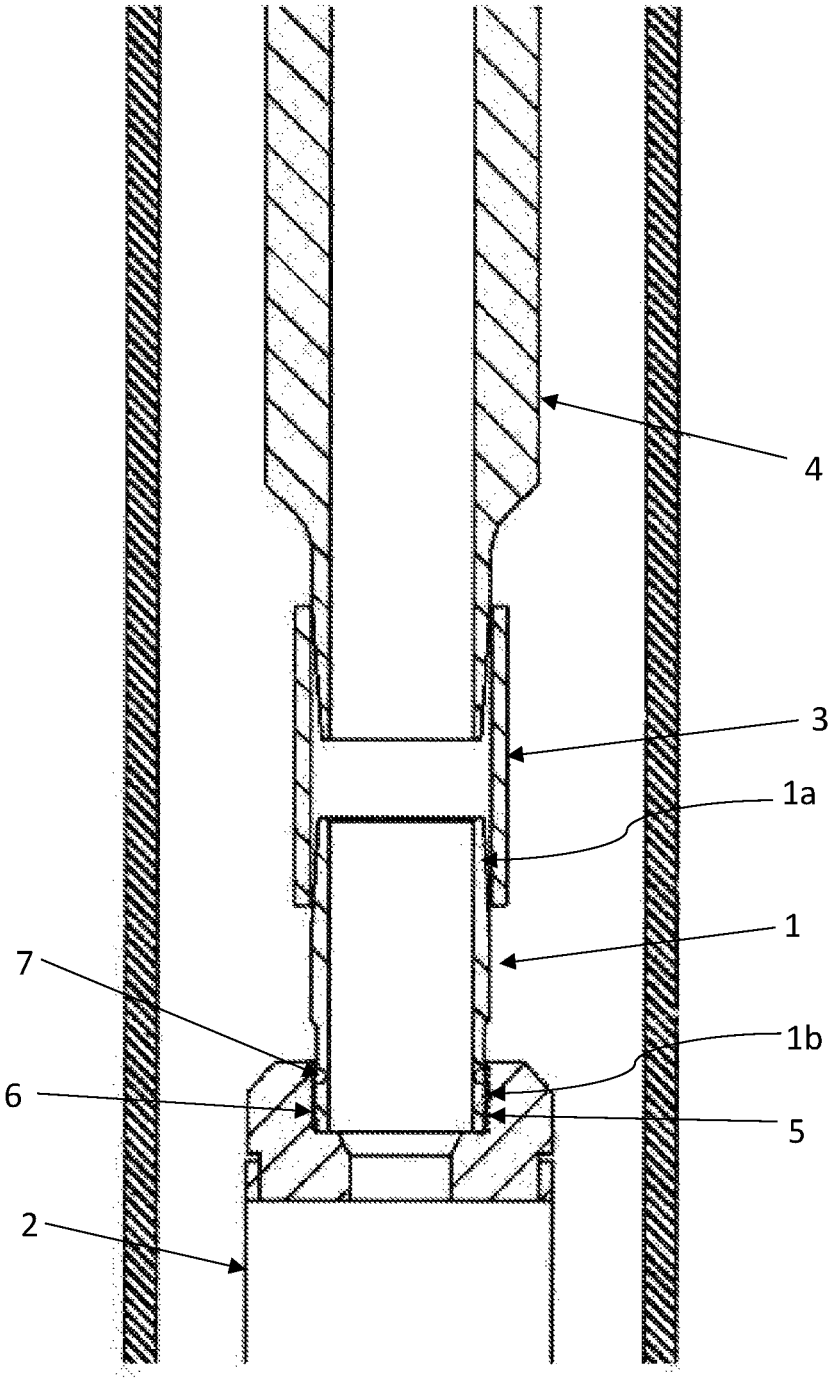
FIG. 5 shows a close up schematic sectional front view of the FIG. 4 disconnect sub showing the left-hand thread and notch.

FIG. 5 shows a close up sectional front view of the disconnect sub 1 and the left-hand thread 5. The plug 2 has a female left hand thread 6 on its bore which has an opposite hand to the normal thread used to make up the standard oilfield connections. The disconnect sub 1 and the plug 2 are connected by anti-clockwise rotation of the disconnect sub 1, and being disconnected by clockwise rotation. The notch 7 on the disconnect sub 1 is a rounded groove 7 of neck formed on the outer surface of the disconnect sub 1 of the lowermost, in use, end of the wall W, such that the notched portion of the disconnect sub 1 has a smaller outer diameter compared to the major diameter of the sub 1. The notch 7 is positioned above the left-hand thread 5. When the left-hand male thread 5 is made up to the female left hand thread 6, the notch 7 is protected from any bending loads as the length of the male end comprising the left-hand thread 5 is shorter than the female thread 6. The notch 7 is therefore contained within the threaded portion of the plug 2 and thereby protected from premature disconnection caused by loading e.g. side/bending loads.

Figure 6:
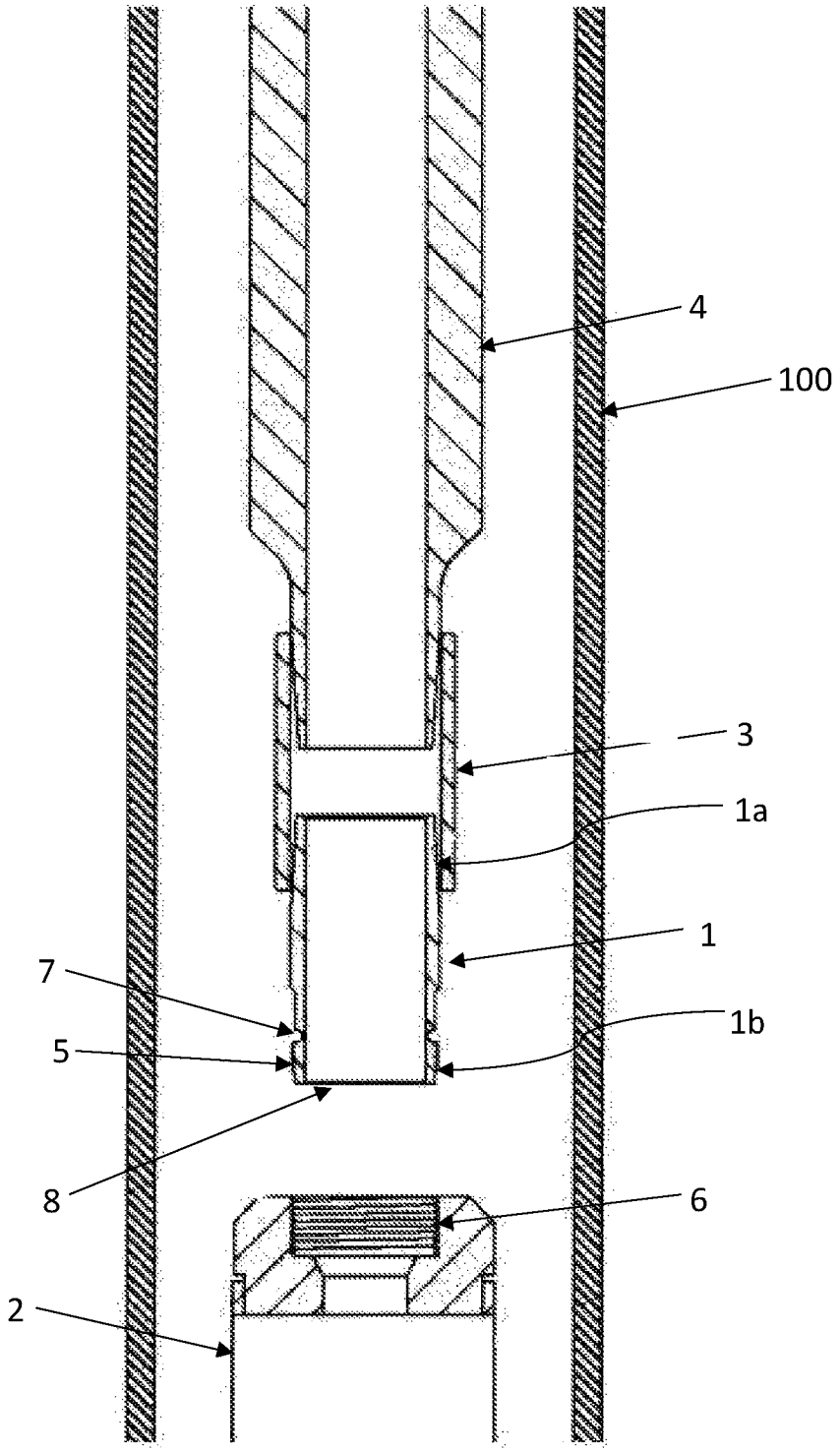
FIG. 6 shows a schematic sectional front view of the FIG. 4 disconnect sub after it has been released from the plug by the preferred method of rotating the drill pipe.

Once the plug 2 has been set in the wellbore 100, the drill pipe 4 is released. In FIG. 6, the drill pipe 4 is released from the plug 2 by clockwise rotation of the drill pipe 4 at the surface. Using clockwise rotation means that the drill pipe connections, typically right-hand threads, will not loosen. As the connection from the disconnect sub 1 to the plug 2 is a left-hand thread, the drill pipe 4 will release from the plug 2 leaving an open-ended pipe 8.

Figure 7:
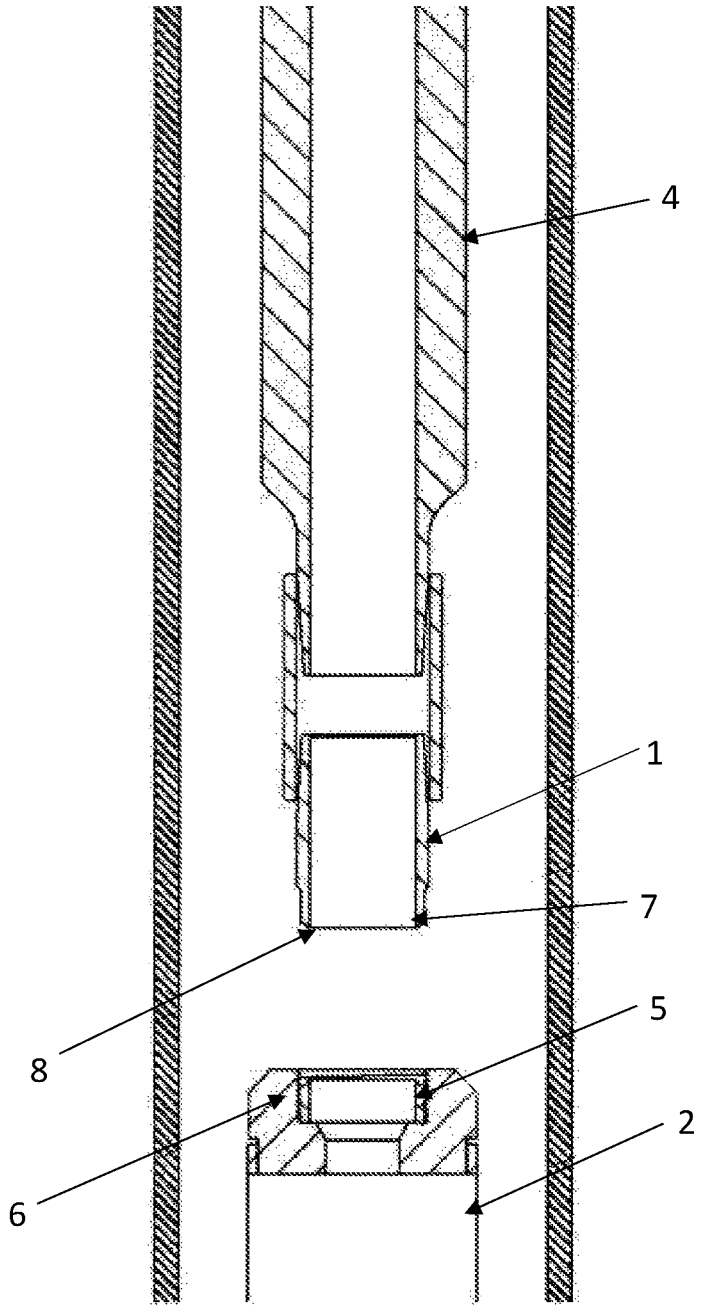
FIG. 7 shows a schematic sectional front view of the FIG. 6 disconnect sub after it has been released from the plug by the alternative method of taking over pull on the drill string and breaking the notch at a predetermined value.

If rotation of the drill pipe 4 is unsuccessful, the plug 2 can be released by taking an over pull on the drill pipe 4 as seen in FIG. 7. The diameter of the notch 7 has a predetermined tensile break value. The profile of the notch 7 is illustrated as an annular groove, with a rounded profile, but can be shaped differently while still providing a clean break e.g. v-shaped groove. The left-hand threaded portion 5 of the disconnect sub remains in the female thread 6 of the plug. An open-ended pipe 8 is left after disconnecting in a similar manner to FIG. 6.

Figure 8:
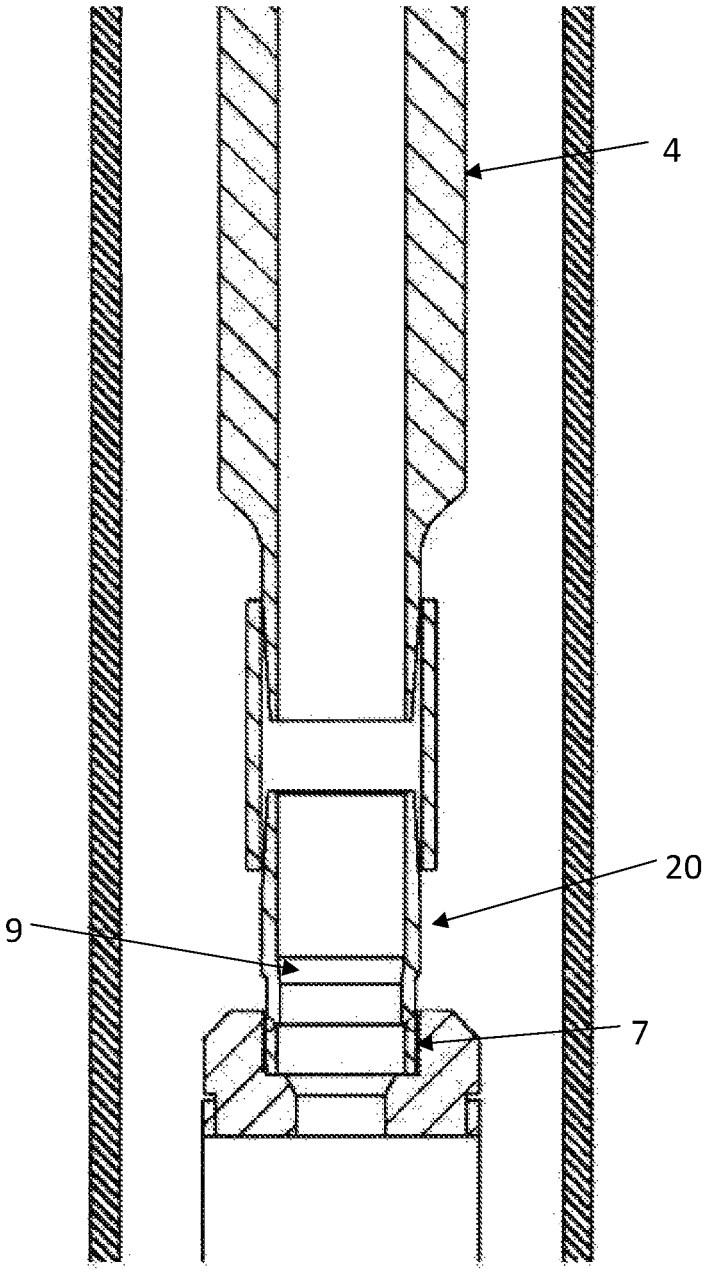
FIG. 8 shows a close up schematic sectional front view of a second embodiment of a disconnect sub in accordance with the invention comprising an internal tapered profile.
Figure 9:
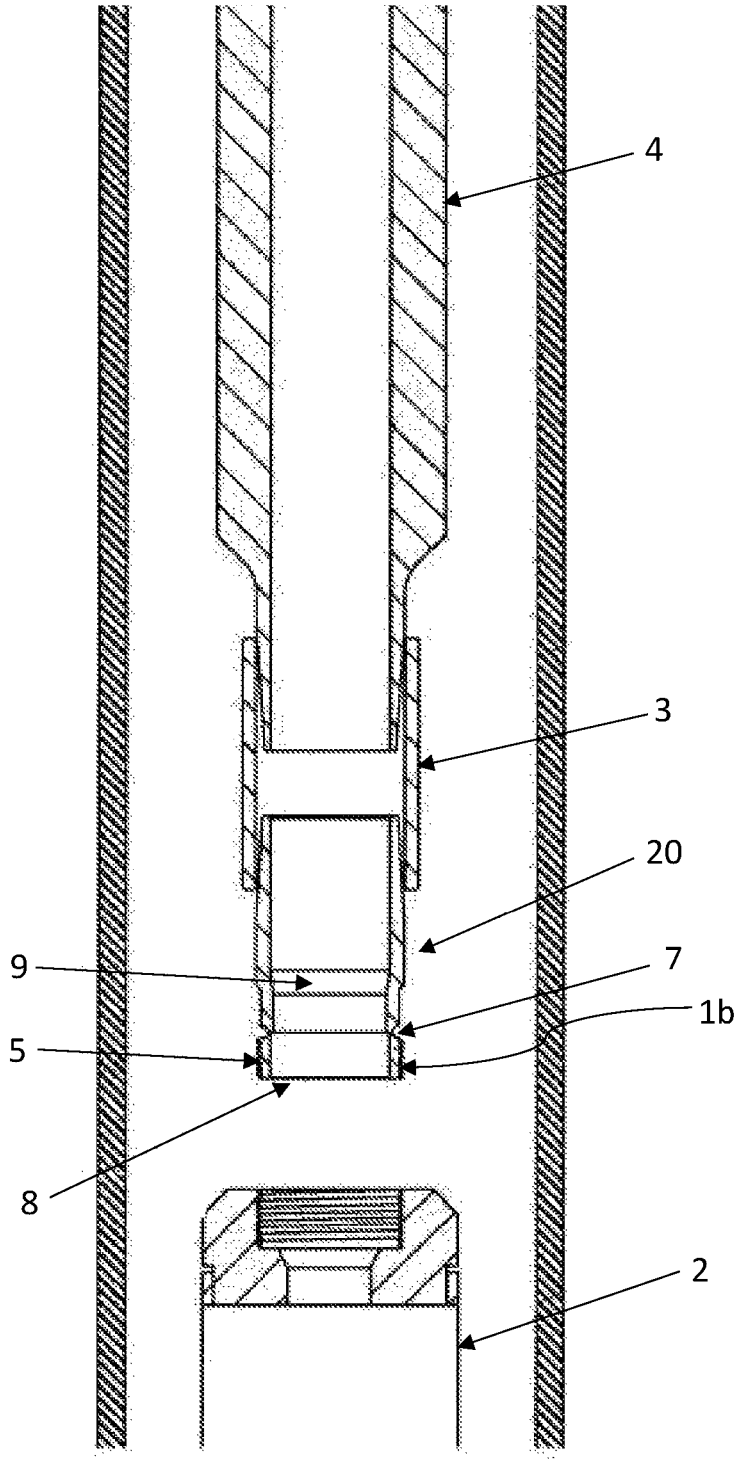
FIG. 9 shows a schematic sectional front view of the FIG. 8 disconnect sub after it has been released from the plug by the preferred method of rotating the drill pipe.
Figure 10:
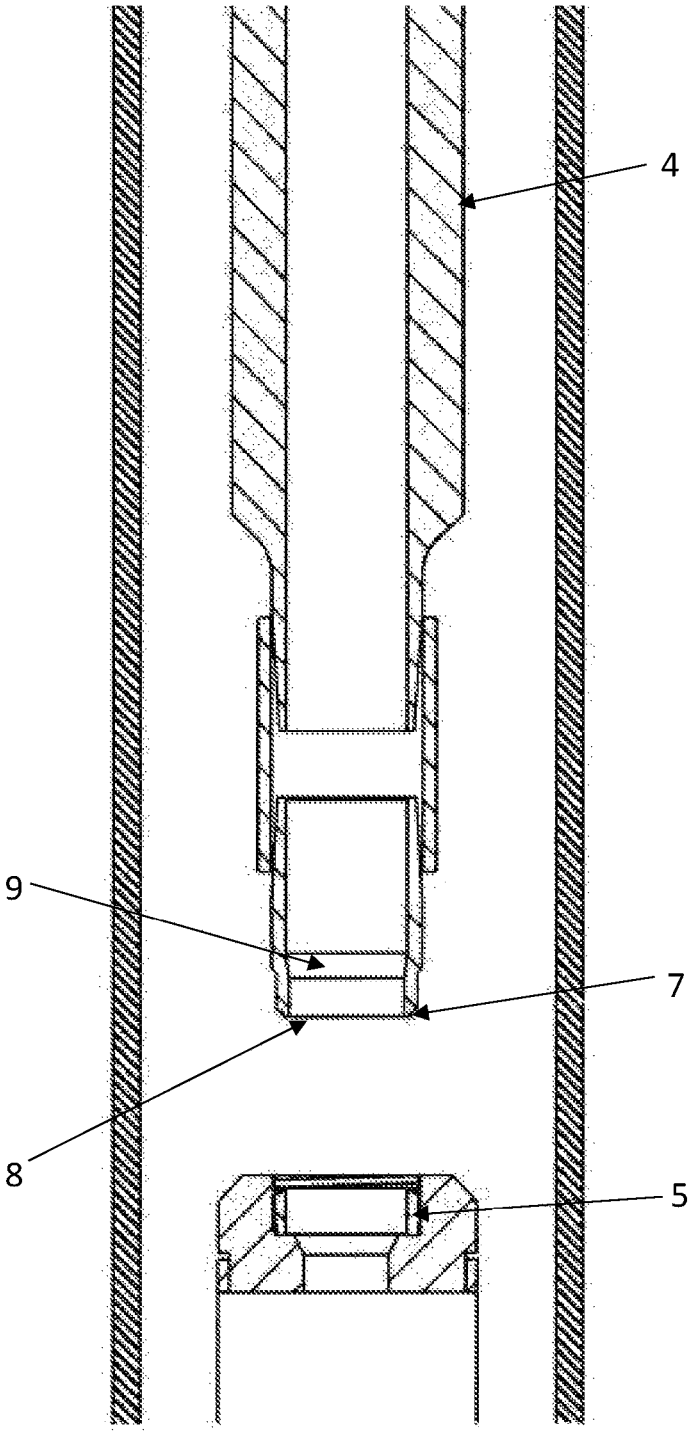
FIG. 10 shows a schematic sectional front view of the FIG. 8 disconnect sub after it has been released from the plug by the alternative method of taking over pull on the drill string and breaking the notch at the predetermined value.

FIGS. 8-10 show an alternative embodiment of the disconnect sub 1 in the form of disconnect sub 20, which differs from disconnect sub 1 by the inclusion of an internal tapered profile 9. The tapered profile 9 narrows from the nominal internal diameter of the drill pipe 4 to a smaller, predetermined, internal diameter as the taper progresses downwards. The tapered profile 9 can be used as a landing profile for further tools. The tapered profile 9 can also be shaped as a nipple profile. Inclusion of the tapered profile 9 will not impact on the tensile break force as the reduced notch diameter 7 contains the thinnest wall section.

FIG. 9 shows the preferred method of releasing the disconnect sub 20 with the tapered profile 9 from the plug 2 by clockwise rotation of the drill pipe 4, leaving an open ended pipe 8 for further cementing/abandonment operations.

FIG. 10 shows the alternative release method of the disconnect sub 20 taking an overpull on the drill pipe 4. The predetermined tensile break value is exceeded and the disconnect sub 20 breaks at the notch 7, exposing an open ended pipe 8. As the tapered profile 9 is positioned above the left-hand thread 5, disconnecting via this alternative release will result in the tapered profile 9 being exposed and within an open ended pipe 8.

Figure 11:
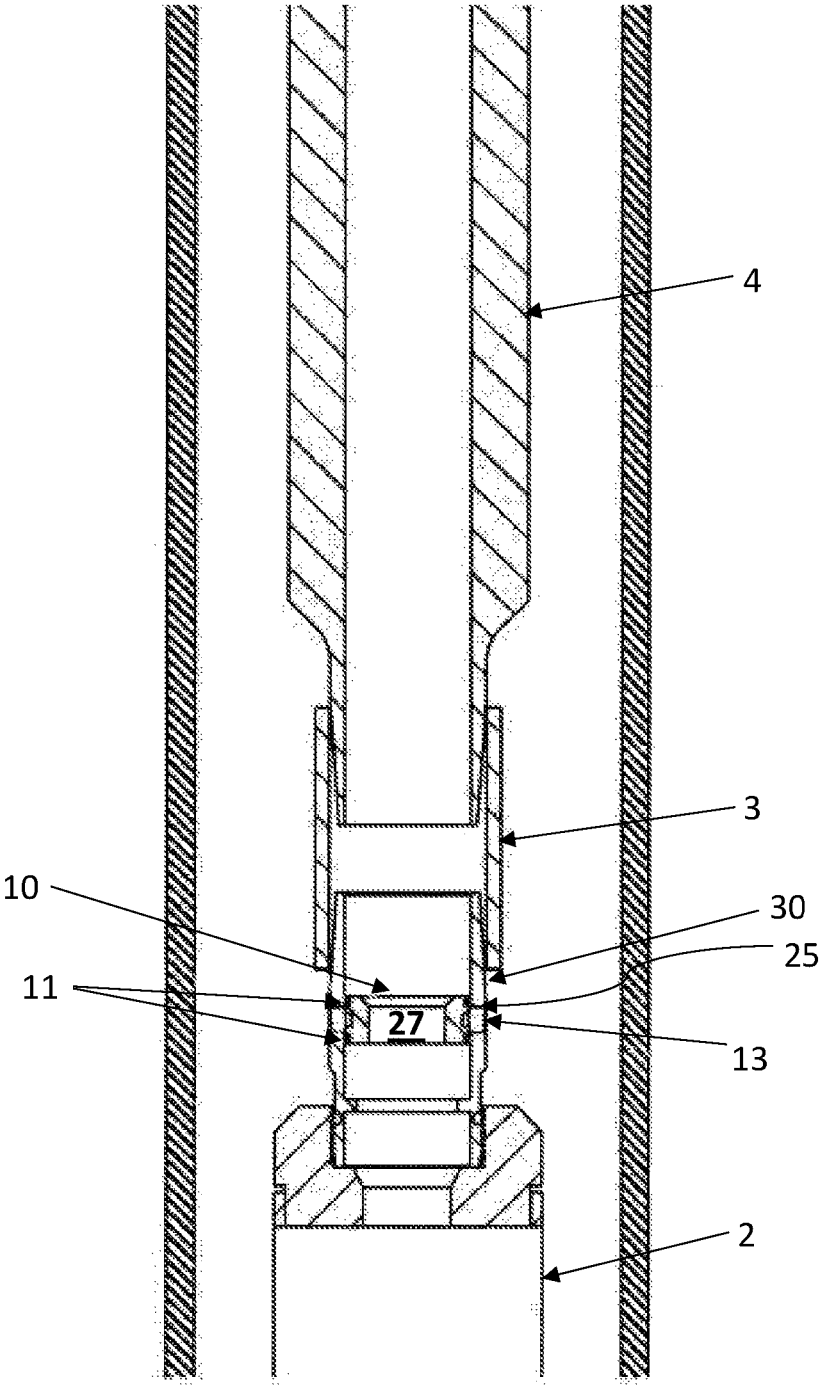
FIG. 11 shows a schematic sectional front view of a third embodiment of a disconnect sub in accordance with the present invention, with a diverter valve comprising a ball seat, polymeric seals and shear pins in the 'running in' position.
Figure 12:
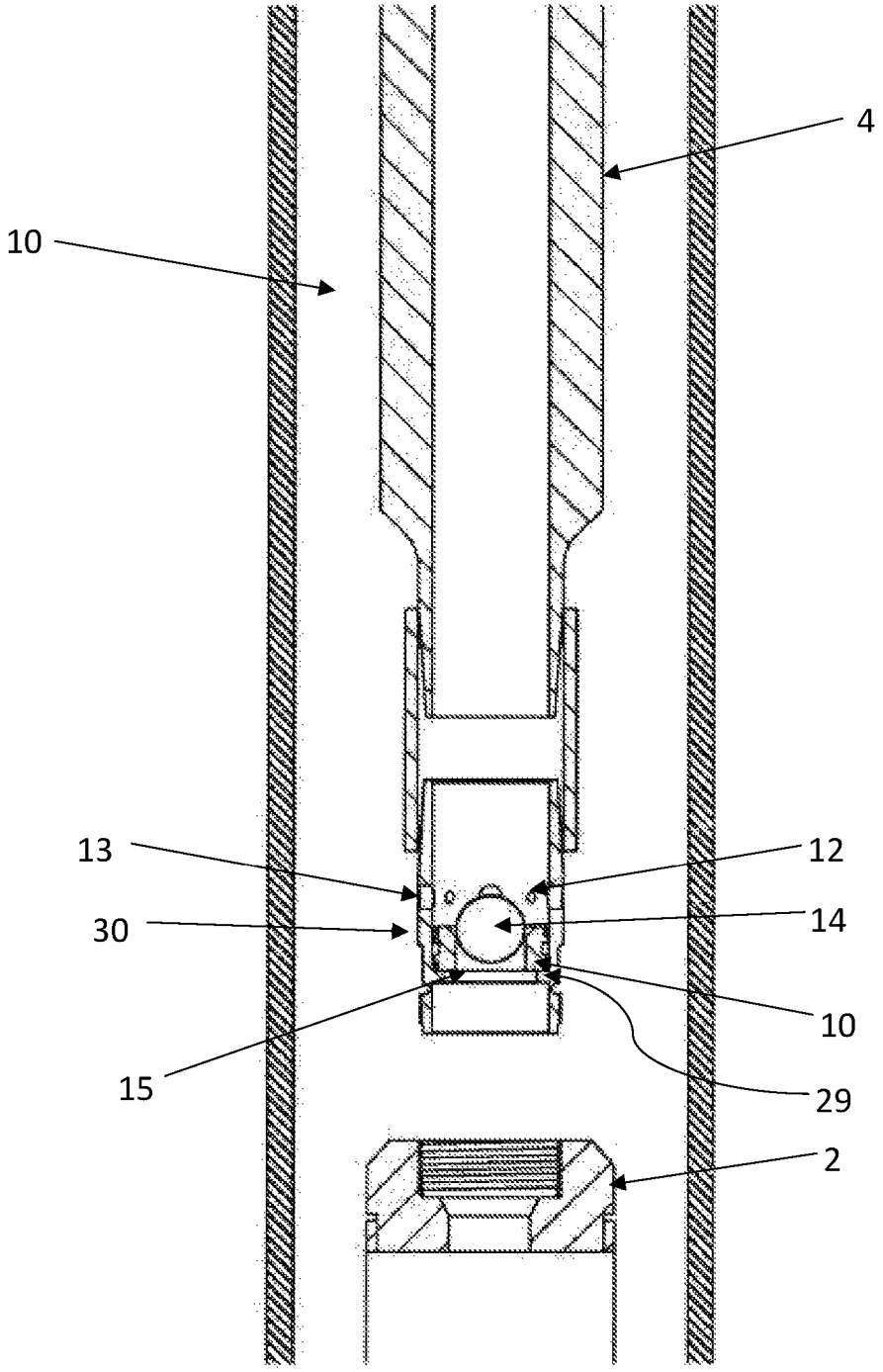
FIG. 12 shows a schematic sectional front view of the FIG. 11 disconnect sub after it has released from the plug via rotation and an activation ball has been dropped and diverted the fluid out the radial ports.
Figure 13:
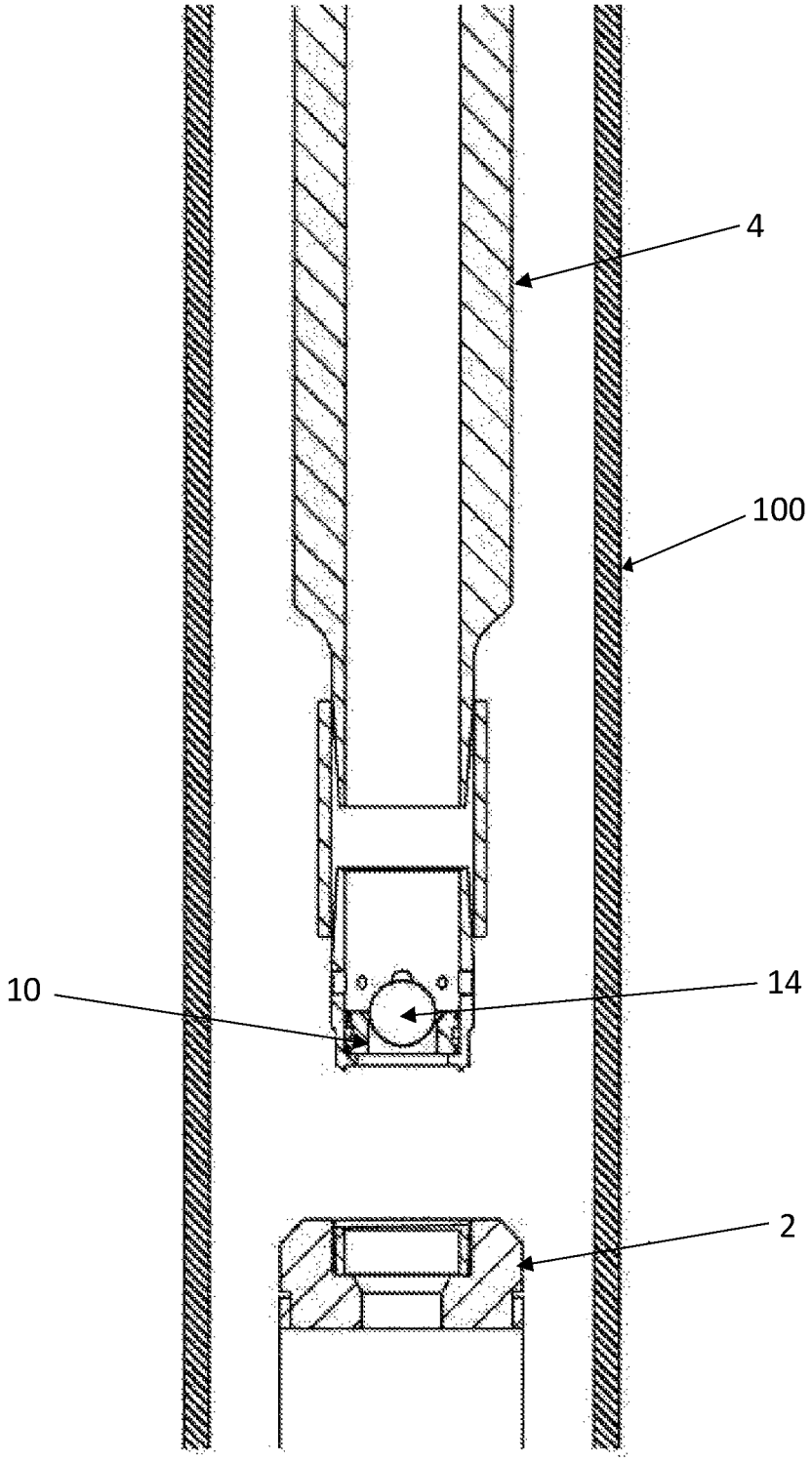
FIG. 13 shows a schematic sectional front view of the FIG. 11 disconnect sub after it has released from the plug via over pull on the drill string and an activation ball has been dropped and diverted the fluid out the radial ports.

FIGS. 11-13 show a further alternative embodiment of the disconnect sub in the form of disconnect sub 30 which differs from disconnect sub 1 by the inclusion of a diverter valve 25. The diverter valve 25 comprises a ball seat 10, seals 11 and shear pins 12. The disconnect sub 30 comprises radial ports 13, which are sealed by the ball seat 10 and seals 11 above and below the ports 13 when the ball seat 10 is in a first configuration. The ball seat 10 comprises a central aperture 27 that permits fluid to flow through the disconnect sub 30 when the ball seat 10 is in the first configuration.

The preferred method of rotation of the drill pipe 4 releases the disconnect sub 30 from the set plug 2. FIG. 12 shows an activation ball 14 dropped from surface through the drill pipe 4 and landed on the ball seat 10. Pressuring up the fluid from the surface acts to break the set of shear pins 12, permitting axial movement of the ball seat 10 downwards into a second configuration. In this second configuration, the radial ports 13 are exposed. A shoulder 29 extending into the inner diameter of the disconnect sub 30 forms a 'no go' 15, which prevents the ball seat 10 from moving further in a down hole direction.

As the radial ports 13 are unsealed, fluid flowing in the throughbore of the drill string 4 is diverted out of the ports 13, and into the wellbore 100.

FIG. 13 shows the alternative release of the disconnect sub 30 comprising the diverter valve 25 from the plug 2 by taking an over pull on the drill pipe 4. Following release of the disconnect sub 30 from the plug 2, an activation ball 14 is dropped after onto the ball seat 10 to move the ball seat 10 into the second configuration as previously described.

Figure 14A:
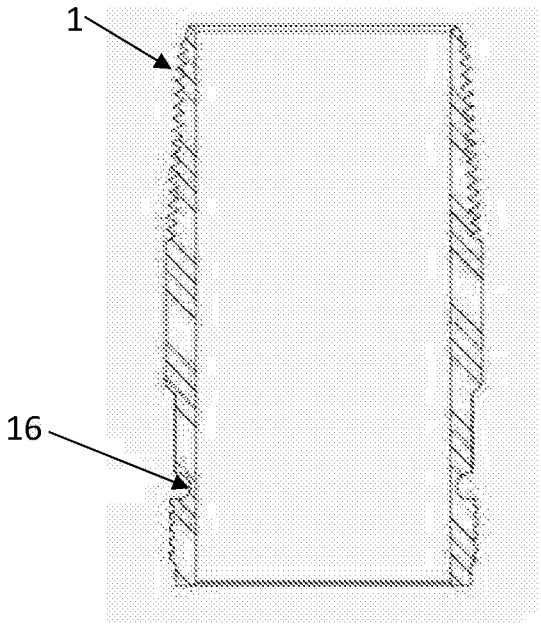
FIG. 14*a* shows a schematic sectional front view of the disconnect sub of FIGS. 1-3 with a notch in the form of an external rounded groove.

FIG. 14*a* shows a cross-sectional view of the disconnect sub 1 of FIGS. 1-3, with a notch in the form of an annular rounded groove 16 formed or machined in the external surface of the body of the sub 1, which acts to significantly thin the wall of the sub 1 at the notched location. The notched location forms the disconnection point of the sub 1.

Figure 14B:
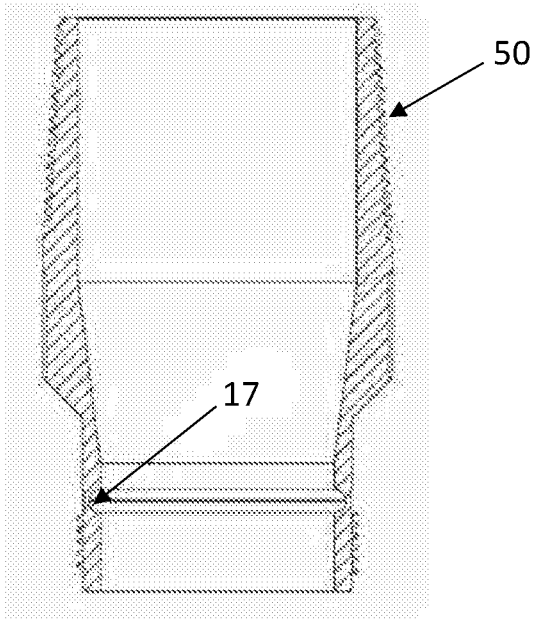
FIG. 14*b* shows a schematic sectional front view of a fourth embodiment of a disconnect sub in accordance with the invention, with a notch in the form of an internal rounded groove.

FIG. 14*b* shows a yet further alternative embodiment of the disconnect sub according to the present invention, where the disconnect sub 50 comprises an annular notch 17 formed on the internal surface of the body of the disconnect sub 50, i.e. the surface of the throughbore, or inner diameter, so that the weak portion of the sub 50 formed by the notch 17 is facing inwardly. The notch 17 is illustrated as a rounded groove but can take any suitable shape. Forming the notch 17 on the internal surface of the disconnect sub 50 as shown advantageously improves the cleanliness of the break when the sub 50 is disconnected by the use of overpull, by reducing the likelihood of burrs and/or ragged edges 42 forming on the open lowermost end of the disconnect sub 50. This results in more (or all) of the internal diameter of the remaining portion of the sub 50 being open, which reduces the risk of a tool getting stuck or damaged as it passes through the bore of the sub 1 (see FIG. 15). This example may be particularly useful when running tools through the disconnection point of the sub 50 is planned.

Figure 15:
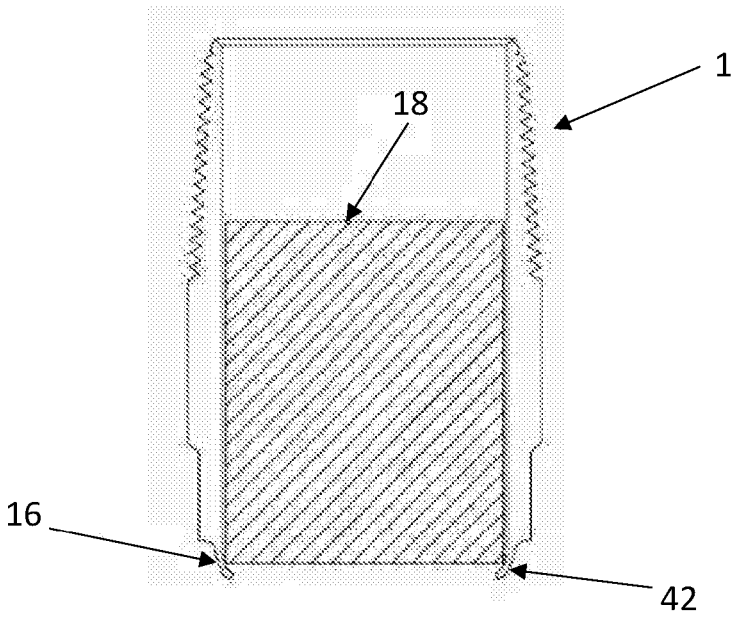
FIG. 15 shows a close up sectional front view of the FIG. 14*a* disconnect sub after it has been released from the plug by over pull, with a piece of pipe being obstructed from passage through the bore due to burrs and ragged edges caused by the break.

FIG. 15 shows the FIG. 14*a* disconnect sub 1 with the external rounded groove notch 16 after it has been released from the plug 2 by the alternative method, i.e. taking an overpull on the drill pipe 4. A piece of solid pipe 18 is being obstructed from passage through the bore of the disconnect sub 1 due to unwanted burrs and ragged edges 42 caused by the break of the disconnect sub 1 at the disconnection point. The importance of a clean break allows a full ID bore with no burrs or residual broken material 42 that can obstruct any tools 18 subsequently run through the disconnection point in the inner diameter of the disconnect sub 1, as provided by the internal groove 17 illustrated in FIG. 14*b*.

Figure 16:
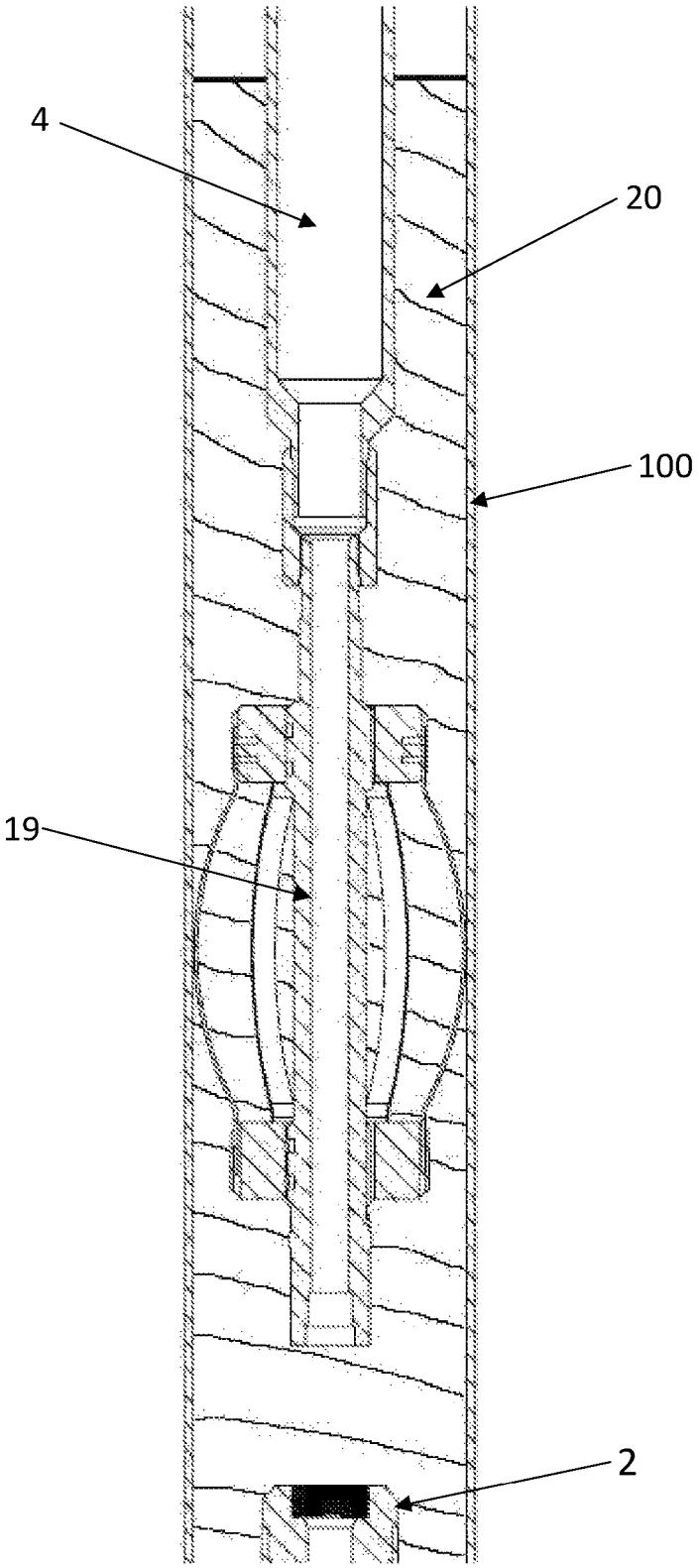
FIG. 16 shows a schematic sectional front view of a known mechanical setting tool (i.e. not in accordance with the present invention) being pulled to surface via drill pipe from the well bore through wet cement.

FIG. 16 shows a known mechanical setting tool 19 being pulled to surface via drill pipe 4 from the well bore 100 through wet cement in the annulus 20 after the mechanical setting tool 20 has been released from the plug 2. In this scenario the mechanical setting tools' 19 large outer diameter (OD) may cause cement disturbance and channeling to occur as the mechanical setting tool 19 is being pulled to surface through the wet cement 20. This could potentially interfere with cementing operations and lead to remedial work being required, and/or failure of the cement.

Figure 17:
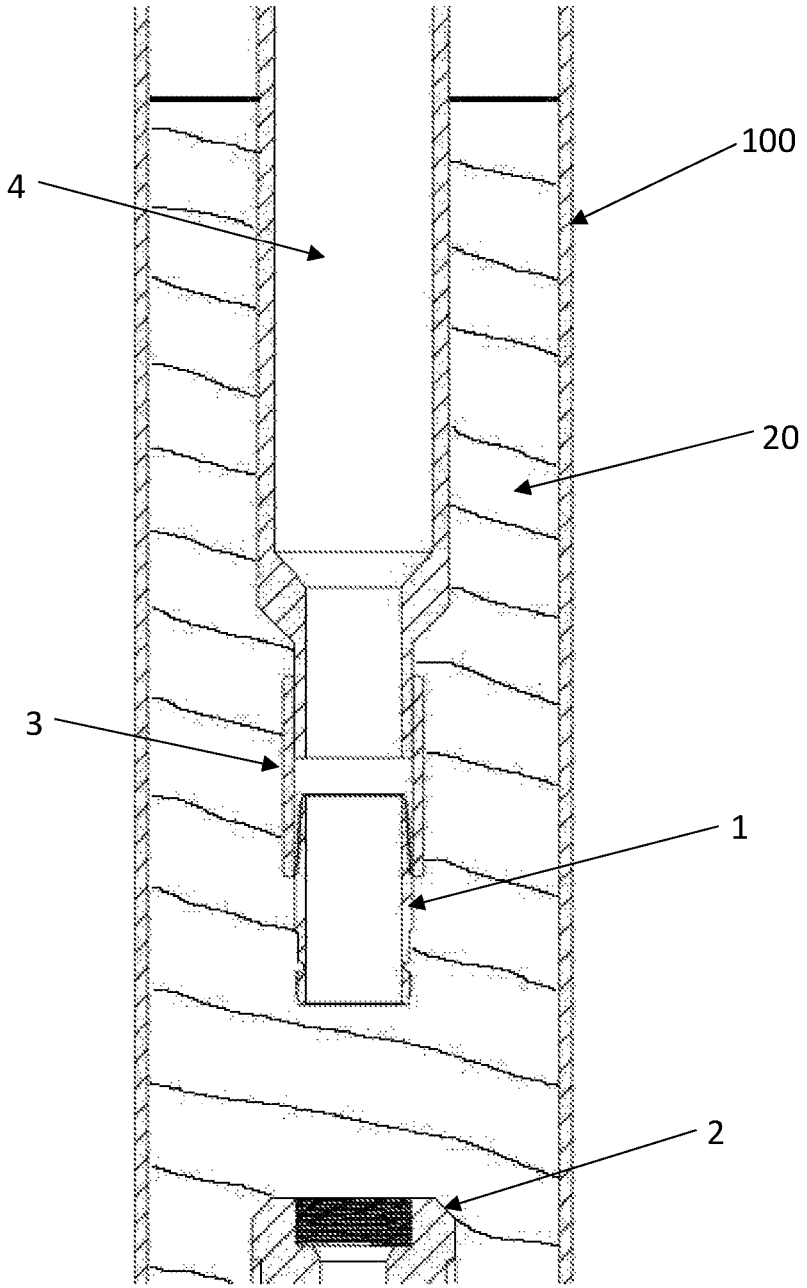
FIG. 17 shows a schematic sectional front view of the slick stinger consisting of the FIG. 4 disconnect sub, coupling and drill pipe being pulled to surface from the wellbore through wet cement.

FIG. 17 shows an alternative to the tool of FIG. 16 comprising a slick stinger including the disconnect sub 1, coupling 3, and drill pipe 4 being pulled to surface from the wellbore 100 through wet cement in the annulus 20 after the disconnect sub 1 has been released from the plug 2 by the preferred method of rotating the drill pipe 4. In this scenario, the small outer diameter of the slick stinger is much less likely to cause cement disturbance and channeling to occur as the slick stinger is being pulled to surface through the wet cement 20. This example may be particularly useful when used with the disconnect sub 30 comprising a diverter valve 25 and radial ports 13, as the cement may be pumped from the surface into the annulus via the radial ports 13. A reduction in disturbance of the cement after it has been dispensed improves the uniformity of the cement and the cement bond within the wellbore 100.

What is claimed:

1. A disconnect sub for releasably connecting a downhole sealing device for deployment in a wellbore of an oil, gas or water well to a pipe string, the disconnect sub comprising:

a body with a wall forming a throughbore, the body having axially spaced apart first and second threaded ends, the first threaded end comprising a left-hand thread for connecting to the downhole sealing device and the second threaded end comprising a right-hand thread for connecting to the pipe string; the wall of the body comprising a disconnection point between first and second parts of the wall of the body, and having a lower tensile break value than the rest of the wall of the body, whereby disconnection of the pipe string from the downhole sealing device is achievable by at least one of:

clockwise rotation of the pipe string and the disconnect sub relative to the downhole sealing device to disconnect the left-hand thread from the downhole sealing device, and application of an axial tensile load to the disconnect sub equal to or greater than the tensile break value of the disconnection point to separate the first and second parts the wall of the body at the disconnection point.

2. A disconnect sub as claimed in claim 1, wherein the disconnect sub comprises a notch in the wall of the body, wherein the wall of the body has a minimum cross-section at the notch thereby forming the disconnection point.

3. A disconnect sub as claimed in claim 2, wherein the notch is located on the external surface of the disconnect sub.

4. A disconnect sub as claimed in claim 2, wherein the notch is a rounded groove.

5. A disconnect sub as claimed in claim 4, wherein the notch extends one of:

around at least a portion of the circumference of the wall of the body;

around the majority of the circumference of the wall of the body; and uninterrupted around the whole circumference of the wall of the body.

6. A disconnect sub as claimed in claim 2, wherein the notch is positioned adjacent to the left-hand thread for connecting to the downhole sealing device, wherein the left-hand thread is a shorter male thread for connecting to a longer left-hand female thread of the downhole sealing device, whereby when the shorter male thread is mated to the longer left-hand female thread, the notch is contained within the left-hand female thread of the downhole sealing device to protect the notch from bending loads.

7. A disconnect sub as claimed in claim 1, wherein the disconnection point has a predetermined tensile break value such that the disconnection point will fail when a threshold value of axial tensile load is applied to the disconnect sub.

8. A disconnect sub as claimed in claim 1, wherein the disconnect sub comprises a tapered internal profile.

9. A disconnect sub as claimed in claim 8, wherein the tapered profile is configured to provide a landing profile.

10. A disconnect sub as claimed in claim 1, in combination with a downhole sealing device comprising a plug.

11. A disconnect sub as claimed in claim 1, wherein the disconnect sub comprises:

a diverter valve, the diverter valve comprising a set of radially-arranged ports extending through the wall of the body between the throughbore of the disconnect sub and the outer surface of the body; and an axially movable sleeve configured to obstruct the radial ports when in a first configuration to thereby restrict fluid flow between the throughbore and the annulus of the wellbore in use, and to expose the radial ports when in a second configuration, thereby permitting fluid flow between the throughbore and the annulus of the wellbore in use.

12. A disconnect sub as claimed in claim 11, wherein the sleeve comprises seals that straddle the radial ports such that the radial ports are sealed in both an uphole and downhole direction.

13. A disconnect sub as claimed in claim 1, wherein the disconnect sub comprises a diverter valve, the diverter valve comprising:

a set of radially-arranged ports extending between the throughbore of the disconnect sub and the outer surface of the body; and an axially movable ball seat, wherein the ball seat comprises a throughbore;

wherein in a first configuration of the ball seat, the ball seat obstructs the radial ports, restricting fluid communication between the throughbore of the disconnect sub and the annulus of the wellbore but permitting fluid flow through the throughbore of the disconnect sub in use; and wherein in a second configuration of the ball seat, fluid flow through the throughbore of the disconnect sub is restricted and fluid communication between the throughbore of the disconnect sub and the annulus is permitted in use.

14. A disconnect sub as claimed in claim 13, wherein the ball seat comprises at least one seal, wherein in the first configuration of the ball seat the seal restricts fluid from entering the radial ports.

15. A disconnect sub as claimed in claim 13, in combination with a ball and wherein the ball seat is configured to receive the ball when dropped from surface, wherein the ball acts to block the throughbore of the ball seat, thereby preventing fluid flow through the throughbore of the ball seat and increasing fluid pressure within the throughbore of the pipe.

16. A disconnect sub as claimed in claim 15, wherein the ball seat is configured to actuate from the first configuration into the second configuration when a threshold pressure is reached within the throughbore.

17. A disconnect sub as claimed in claim 13, wherein the ball seat is restrained in the first configuration by one or more separable member(s).

18. A method of disconnection of a pipe string for deployment in a wellbore of an oil, gas, or water well from a downhole sealing device, the method comprising:

providing a disconnect sub in accordance with claim 1;

connecting the downhole sealing device to the disconnect sub at the first end of the disconnect sub, and connecting the disconnect sub at the second end to the pipe string for running downhole; and disconnecting the pipe string from the downhole sealing device by applying an axial tensile load to the disconnect sub equal to or greater than the tensile break value of the disconnection point.

19. An assembly of a disconnect sub and a downhole sealing device, the disconnect sub for releasably connecting the downhole sealing device for deployment in a wellbore of an oil, gas or water well to a pipe string, the disconnect sub comprising a body with a wall forming a throughbore, the body having axially spaced apart first and second threaded ends, the first threaded end comprising a left-hand male thread for connecting to the downhole sealing device and the second threaded end comprising a right-hand thread for connecting to the pipe string; the wall of the body comprising a disconnection point between first and second parts of the wall of the body, and having a lower tensile break value than the rest of the wall of the body, whereby disconnection of the pipe string from the downhole sealing device is achievable by at least one of:

clockwise rotation of the pipe string and the disconnect sub relative to the downhole sealing device to disconnect the left-hand male thread from the downhole sealing device, and application of an axial tensile load to the disconnect sub equal to or greater than the tensile break value of the disconnection point to separate the first and second parts the wall of the body at the disconnection point, the downhole sealing device having a female threaded connector comprising a left-hand female thread for connecting to the left-hand male thread of the disconnect sub, the female threaded connector having an upper end and an internal bore wherein the disconnection point is located adjacent to the left-hand male thread of the disconnect sub, whereby when the left-hand male thread of the disconnect sub is mated to the left-hand female thread of the downhole sealing device, the disconnection point is located below the upper end of the female threaded connector and within the internal bore of the female threaded connector to protect the disconnection point from bending loads.

* * * * *